US007338021B2

(12) United States Patent
Barkdoll et al.

(10) Patent No.: US 7,338,021 B2
(45) Date of Patent: Mar. 4, 2008

(54) METAL STAMPED HOOK BACK

(75) Inventors: Patrick J Barkdoll, Pecatonica, IL (US); David Roger Young, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 251 days.

(21) Appl. No.: 11/191,225

(22) Filed: Jul. 28, 2005

(65) Prior Publication Data

US 2007/0023464 A1 Feb. 1, 2007

(51) Int. Cl.
*A47B 96/06* (2006.01)
*A47F 5/00* (2006.01)

(52) U.S. Cl. ..... 248/220.31; 211/57.1

(58) Field of Classification Search ..... 248/220.31, 248/220.41, 220.22; 211/57.1, 59.1
See application file for complete search history.

(56) References Cited

U.S. PATENT DOCUMENTS 3,452,954 A * 7/1969 Lucietto et al. ..... 248/220.22
3,912,084 A 10/1975 Valiulis
3,964,712 A * 6/1976 Staudte, Jr. ..... 248/220.22
4,286,764 A * 9/1981 Pfeifer ..... 248/220.22
4,303,217 A * 12/1981 Garfinkle ..... 248/220.42
4,436,209 A * 3/1984 Thalenfeld ..... 211/57.1
4,452,360 A 6/1984 Barnes
4,474,351 A 10/1984 Thalenfeld
4,512,481 A * 4/1985 Thalenfeld ..... 211/57.1
4,516,681 A * 5/1985 Jahel ..... 211/59.1
4,662,592 A * 5/1987 Garfinkle ..... 248/220.42
4,674,721 A 6/1987 Thalenfeld
4,688,683 A * 8/1987 Thalenfeld et al. ..... 211/57.1
4,976,058 A 12/1990 Valiulis
5,080,238 A * 1/1992 Hochman ..... 211/59.1
6,601,808 B1 * 8/2003 Nagel ..... 248/220.31

* cited by examiner

*Primary Examiner*—Anita M. King
(74) *Attorney, Agent, or Firm*—Reinhart Boerner Van Deuren P.C.

(57) ABSTRACT

A back unit for use in a display hanger assembly is provided. The back unit comprises a body, arms, and mounting tabs. The body includes a vertical channel. The vertical channel forms a concave surface on a first side and a convex surface on a second side. The arms are integrally formed with the body and extend outwardly away from the first side. The arms include a slot. The mounting tabs are integrally formed with the body and extend outwardly away from the second side.

23 Claims, 10 Drawing Sheets

METAL STAMPED HOOK BACK

FIELD OF THE INVENTION

The present invention relates generally to display hooks, and more particularly to stamped metal mounting backs for display hooks.

BACKGROUND OF THE INVENTION

There are a variety of different types of display hangers or hooks that are presently in wide use. One of those display hooks is a standard "single arm wire hook" of the type disclosed in U.S. Pat. No. 3,912,084 to Valiulis. A second of the display hooks is a "scanner hook" of the type disclosed in U.S. Pat. No. 4,452,360 to Barnes. The scanner hook includes a lower horizontally extending hanger arm for supporting merchandise and an upper parallel arm for supporting a price tag which may be "read" by an electronic scanning wand.

Like the two display hooks noted above, many display hooks are constructed from a single piece of metal. As such, the end of the display hook typically having the label thereon must be tilted upwardly to a great degree to permit the ends of mounting tabs to enter holes in a peg board. The need for excessive tilting of the display hooks limits the number of locations in the peg board that the display hooks can be placed.

In an attempt to make the installation of a display hook into a peg board easier, display hooks have been separated into two pieces. For example, a two-piece display hook is disclosed in U.S. Pat. No. 4,674,721 to Thalenfeld. In Thalenfeld, a base is first installed into the peg board and, thereafter, a display hook is engaged with the installed base. Unfortunately, installation of the display hook within the base still requires that the display hook be tilted upward. As before, this undesirably limits the locations where the display hook can be employed.

Further, many of the bases for display hooks include a body, or more particularly a central body portion, that is flat or generally planar. Since the base is often formed from a stamped metal, such a planar central body portion can be quite weak and susceptible to bending, creasing, and the like and may simply fail in use. Therefore, there is a need in the art for a hook back with a more sturdy and/or strong central body portion.

Additionally, some of the bases formed by metal stamping require that numerous bends of the metal be performed. Each of these bends takes time and effort to accomplish and, therefore, it would be advantageous to have a base for a display hook that requires fewer bends and/or less manipulation of the metal from which it is formed.

Thus, the related art has failed to provide a commercially feasible and economical display hook that can be installed anywhere on a peg board and is not susceptible to accidental removal.

BRIEF SUMMARY OF THE INVENTION

One aspect of the present invention is directed toward a back unit for use in a display hanger assembly. The back unit comprises a body, arms, and mounting tabs. The body has a vertical channel. The vertical channel forms a concave surface on a first side and a convex surface on a second side. The arms are integrally formed with the body. The arms extend outwardly away from the first side and include a slot.

The mounting tabs are integrally formed with the body. The mounting tabs extend outwardly away from the second side.

Another aspect of the present invention is directed toward a back unit for use in a display hanger assembly. The display hanger assembly includes a hanger arm and a crossbar. The display hanger assembly is compatible with a peg board having holes. The back unit comprises a body, arms, and mounting tabs. The body has a vertical channel that forms a concave surface on a first side of the body and a convex surface on a second side of the body. The concave surface is engageable with the hanger arm. A portion of the convex surface is engageable with the peg board. The arms are integrally formed with the body. The arms extend outwardly away from the first side and include a slot dimensioned to receive the crossbar. The mounting tabs are integrally formed with the body. The mounting tabs extend outwardly away from the second side and are insertable into the holes in the peg board.

Another aspect of the present invention is directed toward a display hanger assembly for displaying merchandise. The display hanger assembly comprises a hanger and an integral back unit. The hanger has a vertical portion and a crossbar. The crossbar is transversely affixed to the vertical portion. The integral back unit is formed from a single piece of metal and includes a body, arms, and mounting tabs. The body has a vertical channel that forms a concave surface on a first side of the body and a convex surface on a second side of the body. The concave surface is engage able with the vertical portion of the hanger arm. The arms are integrally formed with the body. The arms extend outwardly away from the first side and include a slot. The slot is dimensioned to receive the crossbar. The mounting tabs are integrally formed with the body and extend outwardly away from the second side.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
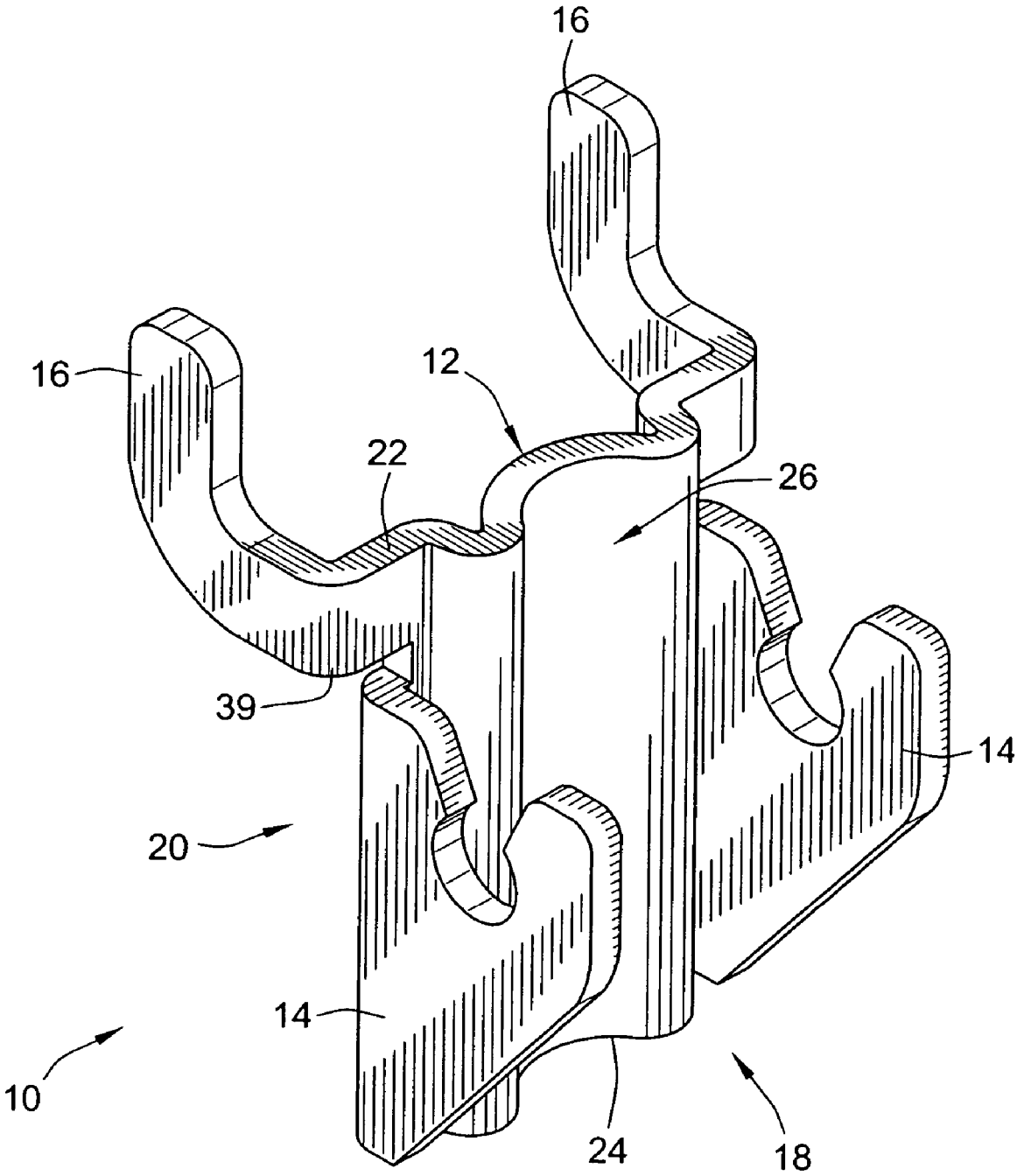
FIG. 1 is a perspective view of an exemplary embodiment of a metal stamped hook back or back unit constructed in accordance with the teachings of the present invention.

Referring to FIG. 1, a metal stamped hook back or back unit 10 is illustrated. Advantageously, the back unit 10 has an increased cross section, is strong, durable, and sufficiently stiff, has the ability to positively retain a hanger yet, with sufficient upward pressure, be biased upwardly for replacement, removal, repositioning, and the like. Additionally, another significant advantage regards the method of installation for the back unit. Because only the back unit 10 needs to be tilted, back unit 10 can be used in locations where conventional or typical display hangers cannot. The back unit 10 comprises a body 12, arms 14, and mounting tabs 16. The back unit 10 is preferably formed from a single piece of material such as, for example, stamped as a single piece from metal. As such, the body 12, arms 14, and mounting tabs 16 are all preferably integrally formed and unitary with each other.

Figure 2:
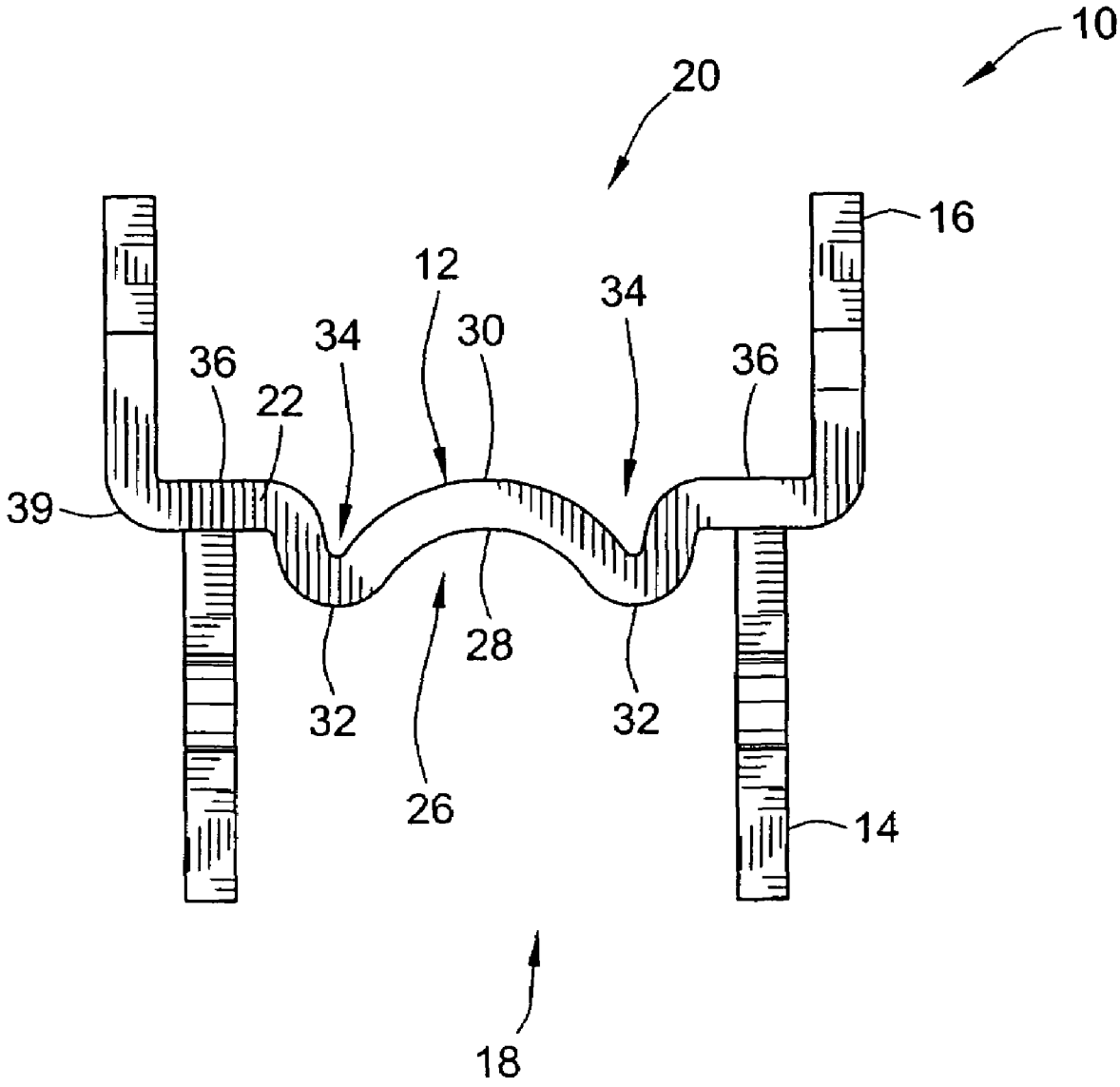
FIG. 2 is a top plan view of back unit of FIG. 1.

The body 12 defines a first side 18, a second side 20, a top end 22, and a bottom end 24. As shown in FIG. 1, the body 12 includes a vertical channel 26. The vertical channel 26 generally extends from the top end 22 to the bottom end 24 of the body 12. As best shown in FIG. 2, the vertical channel 26 forms a concave surface 28 on the first side 18 of the body 12 and a convex surface 30 on the second side 20 of the body. Additionally, the vertical channel 26 forms a pair of parallel vertical ridges 32 on the first side 18 and, correspondingly, parallel recessed portions 34 on the second side 20. Like the vertical channel 26, the vertical ridge 32 and recessed portions 34 generally extend from the top end 22 to the bottom end 24 of the body 12.

Figure 3:
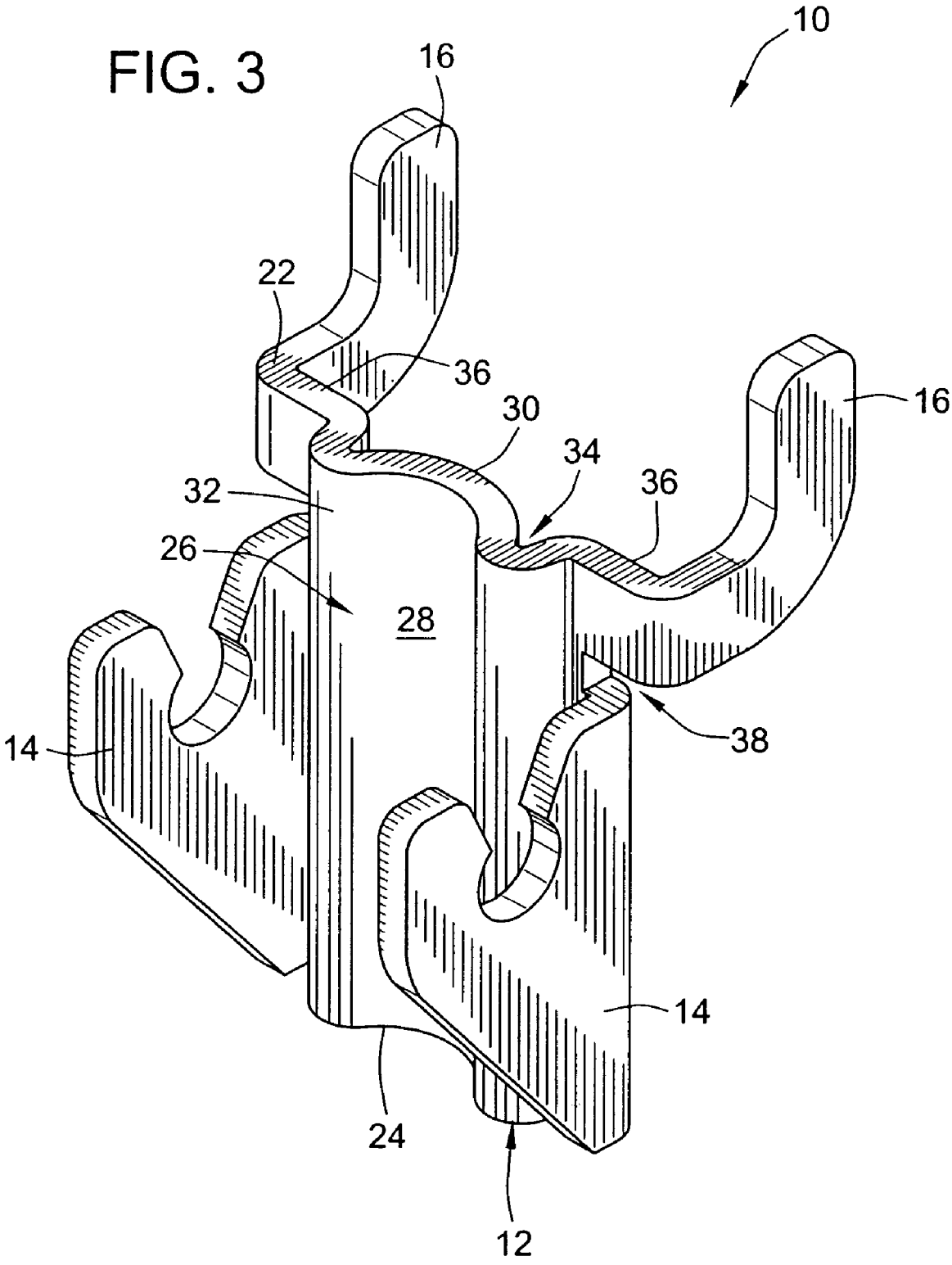
FIG. 3 is another perspective view of the back unit of FIG. 1 taken from an vantage point.

Still referring to FIG. 2, the body 12 further includes abutment surfaces 36 formed on the second side 20 of the body 12. As illustrated in FIG. 3, the abutment surfaces 36 generally extend between the top end 22 and the bottom end 24 of the body 12. The abutment surfaces 36 are generally outside the vertical channel 26 and adjacent to the recessed portions 34 and/or the vertical ridges 32. In one embodiment, each abutment surface 36 is interrupted by a notch 38. Each notch 38 is, in one embodiment, formed into the body 12 a distance that is equal to the width of the arm 14. As such, the notches 38 aid in the formation of the back unit 10 from a single piece of stamped metal. In particular, the arms 14 can be more easily bent transverse to the abutment surfaces 36 (and also in an opposite direction relative to the mounting tabs 16), and generally the body 12, when the notches 38 are provided. When bent in this manner, the arms 14 form an elbow 39 or bend (FIG. 2).

Figure 4:
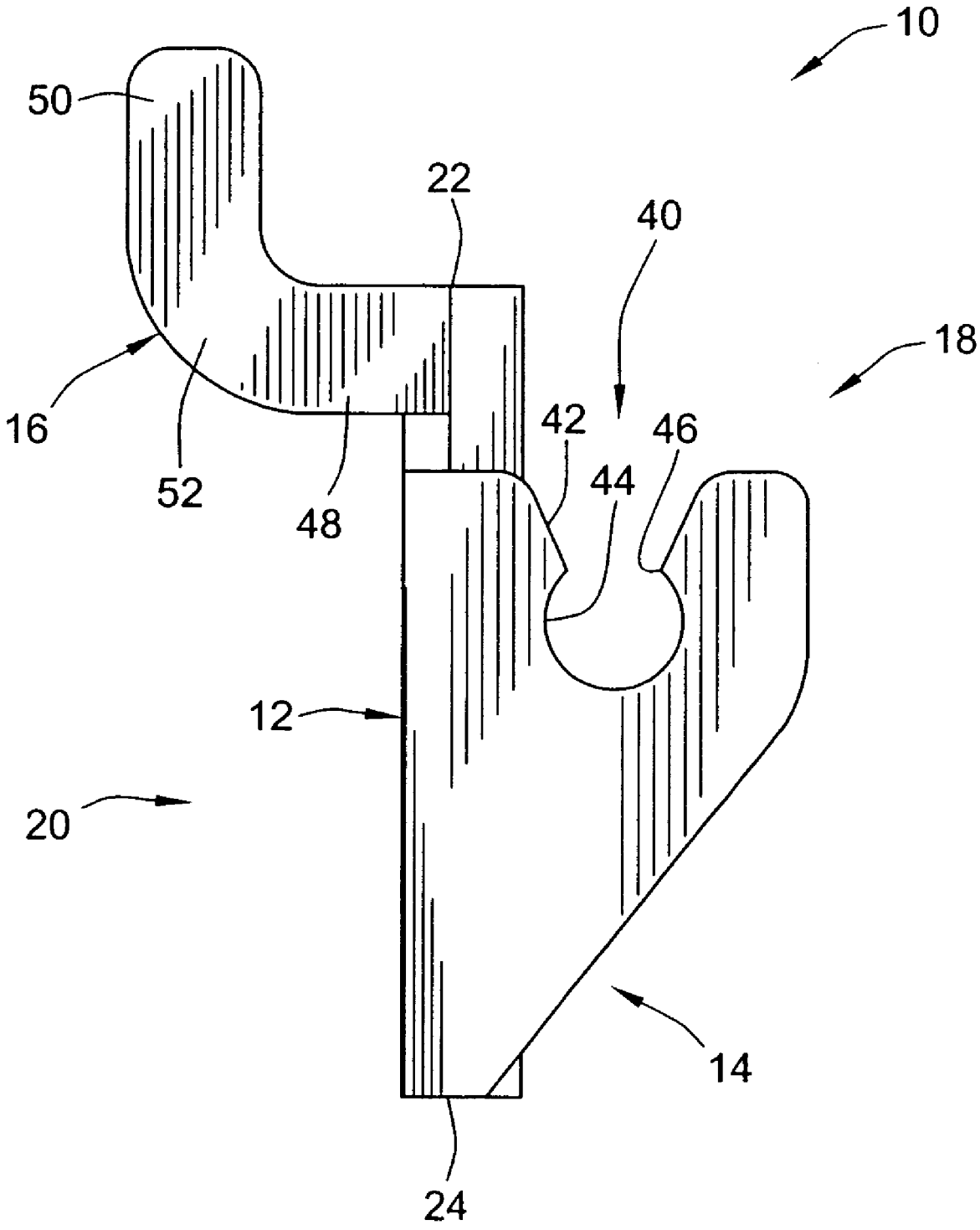
FIG. 4 is a side elevation view of the back unit of FIG. 1.

As shown in FIG. 4, the arms 14 extend outwardly and away from the first side 18 of the body 12. Each of the arms 14 has formed therein a slot 40. In a preferred embodiment, the slot 40 includes a funnel portion 42 and an arcuate portion 44 that forms the sides and bottom of the slot. Where the funnel portion 42 and the arcuate portion 44 of the slot intersect, one or more locking elements 46 or contact points are formed. Notably, the slot 40 and the funnel portion 42 are open proximate the top end 22 of the body 12.

Still referring to FIG. 4, the mounting tabs 16 extend outwardly and away from the second side 20 of the body 12. The mounting tabs 16 include a generally horizontal portion 48 and a generally vertical portion 50 coupled by an elbow portion 52. The mounting tabs 16 are generally parallel with one another and, in a preferred embodiment, extend above the top end 22 of the body 12. In the disclosed embodiment, as best shown in FIG. 2, the outermost extremities of the mounting tabs 16 are outwardly displaced further than the arms 14 with respect to the body 12. Even so, the arms 14 and the mounting tabs 16 are parallel to each other and generally transverse to the body 12.

Figure 5:
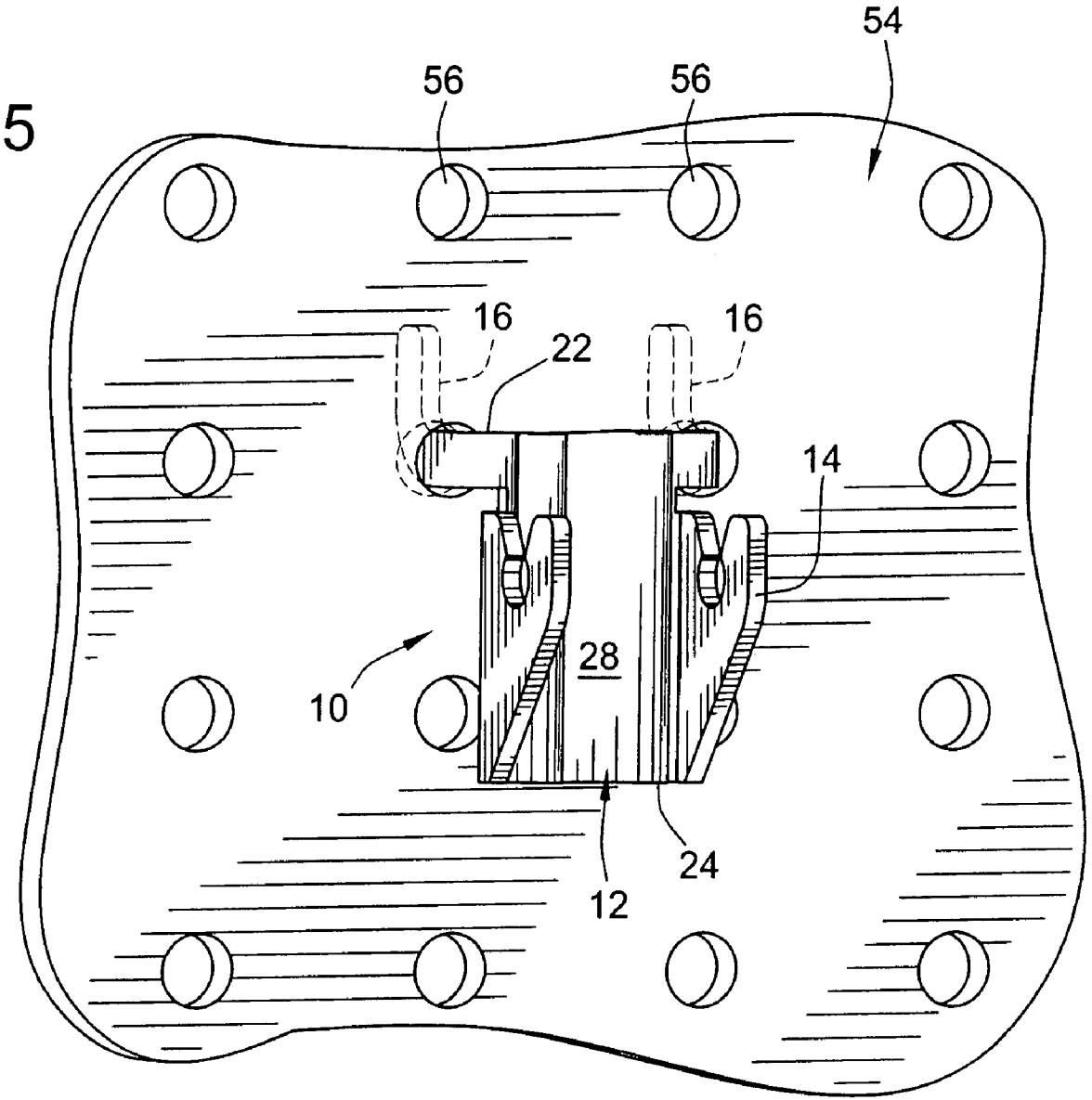
FIG. 5 is a perspective view of the back unit of FIG. 1 mounted to a peg board.
Figure 6:
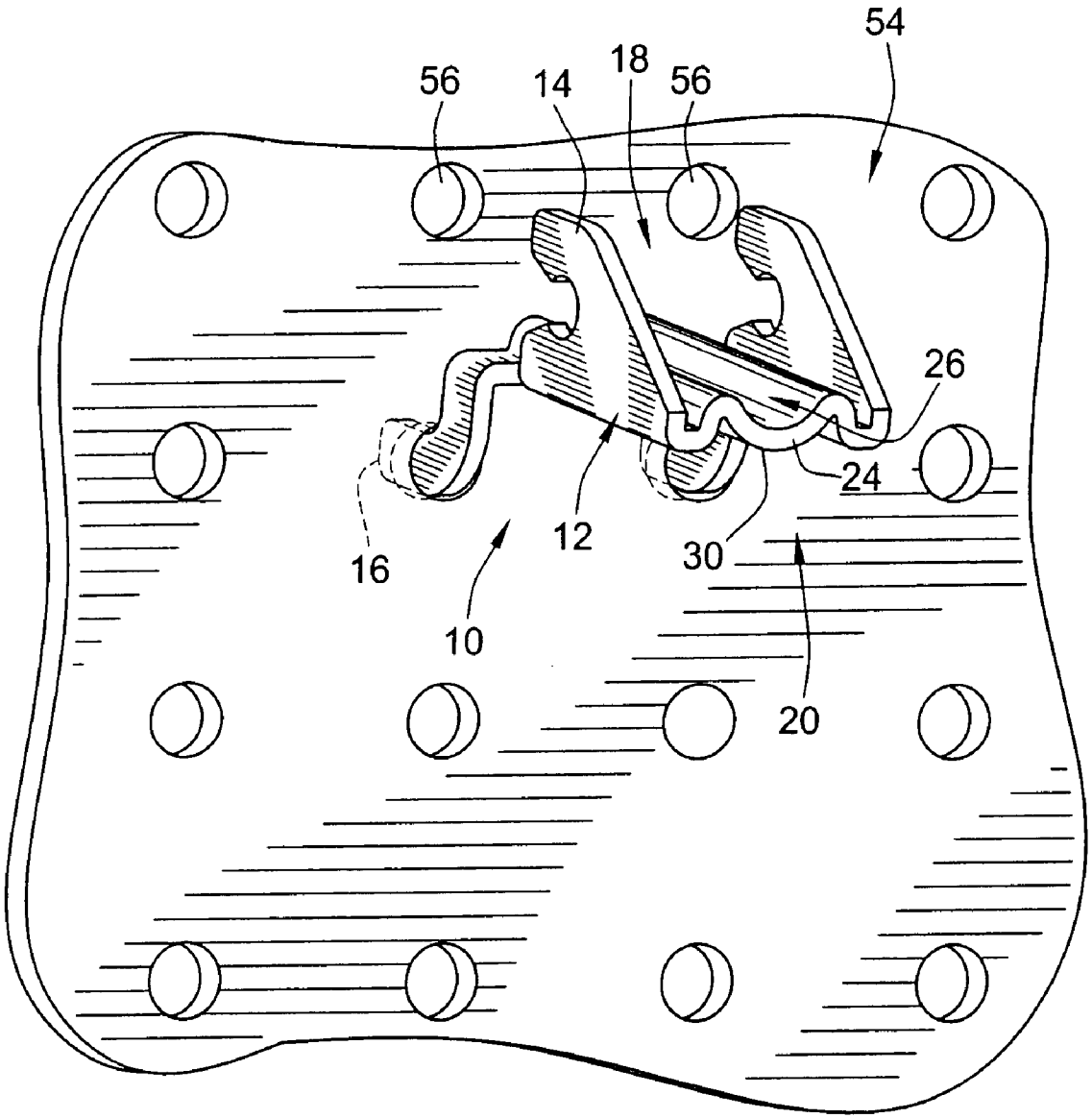
FIG. 6 is a perspective view of the back unit of FIG. 1 in a tilted position relative to the pegboard of FIG. 5 to facilitate insertion or removal of the back unit from the peg board.
Figure 7:
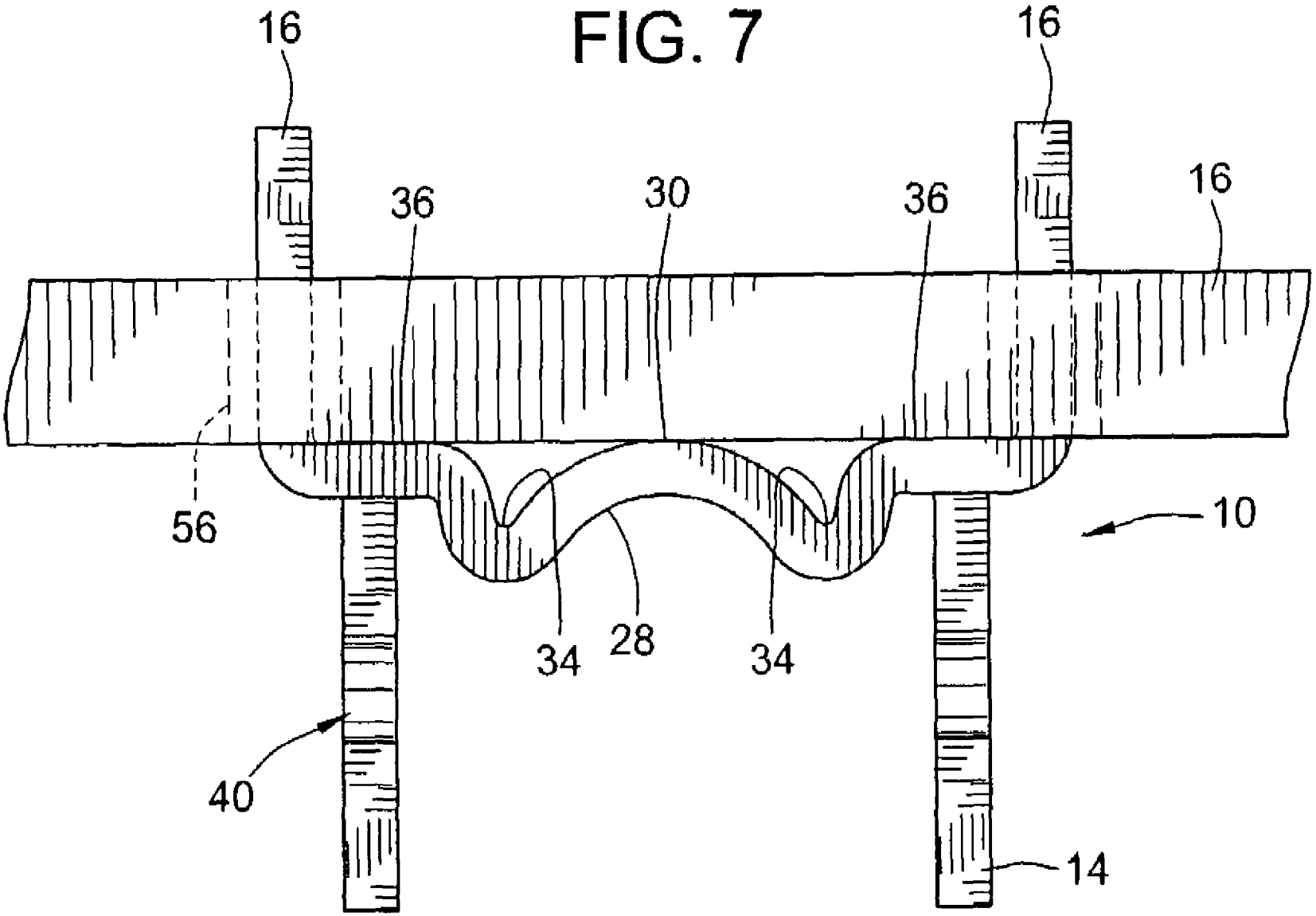
FIG. 7 is a top plan view of the back unit of FIG. 1 when mounted to the peg board.

In FIG. 5, the back unit 10 is illustrated as installed and/or mounted to a perforated panel or peg board 54 of the type formed of a series of vertically-spaced and horizontally extending rows of holes 56. As depicted in FIG. 6, the back unit 10 is installed and/or mounted in the peg board 54 by tilting the bottom end 24 of the body 12 upwardly, with respect to the top end 22, such that the vertical portions 50 of the mounting tabs 16 can be slid within the holes 56 of the peg board 54. With the vertical portions 50 of the arms 14 inserted in the holes 56, the body 12 is rotated such that the bottom end 24 progresses toward the peg board 54 until the back unit 10 is generally engaged with the peg board as shown in FIG. 7. As FIG. 7 illustrates, in a preferred embodiment, when the back unit 10 is secured to the peg board 54, a portion of the convex surface 30 and the abutment surfaces 36 engage the peg board 54. In contrast, the recessed portions 34 are disposed away from, and do not engage, the peg board 54.

To remove the back unit 10 from engagement with the peg board 54, the above installation procedure is generally reversed. As such, the back unit 10 is releasably engageable and/or securable with the peg board 54. The back unit 10 safely permits merchandise to be suspended and displayed yet can be easily repositioned and/or removed conveniently and quickly.

Figure 8:
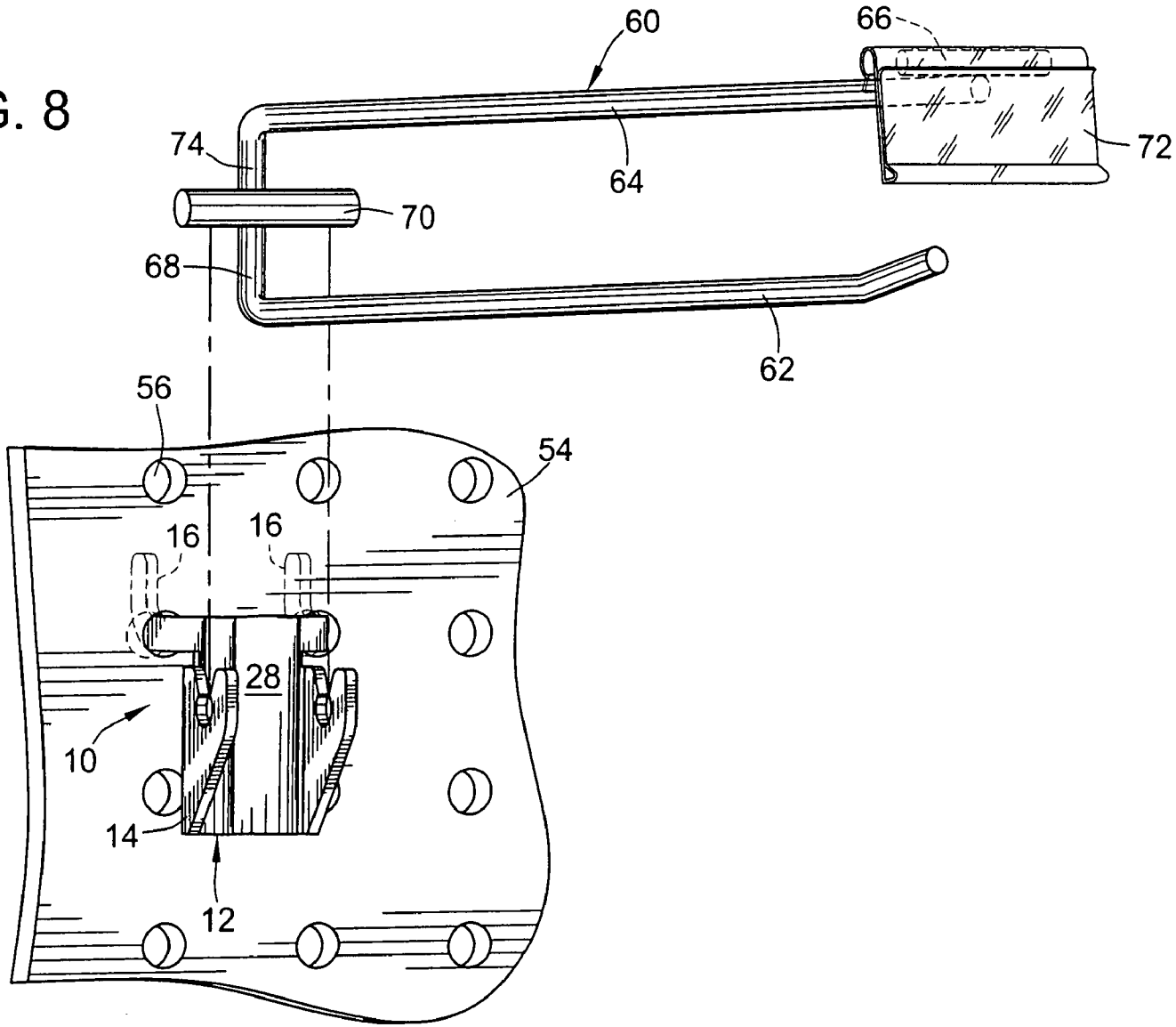
FIG. 8 is an exploded perspective view of the back unit of FIG. 1 incorporated into a display hanger assembly and mounted to the peg board of FIG. 5.
Figure 9:
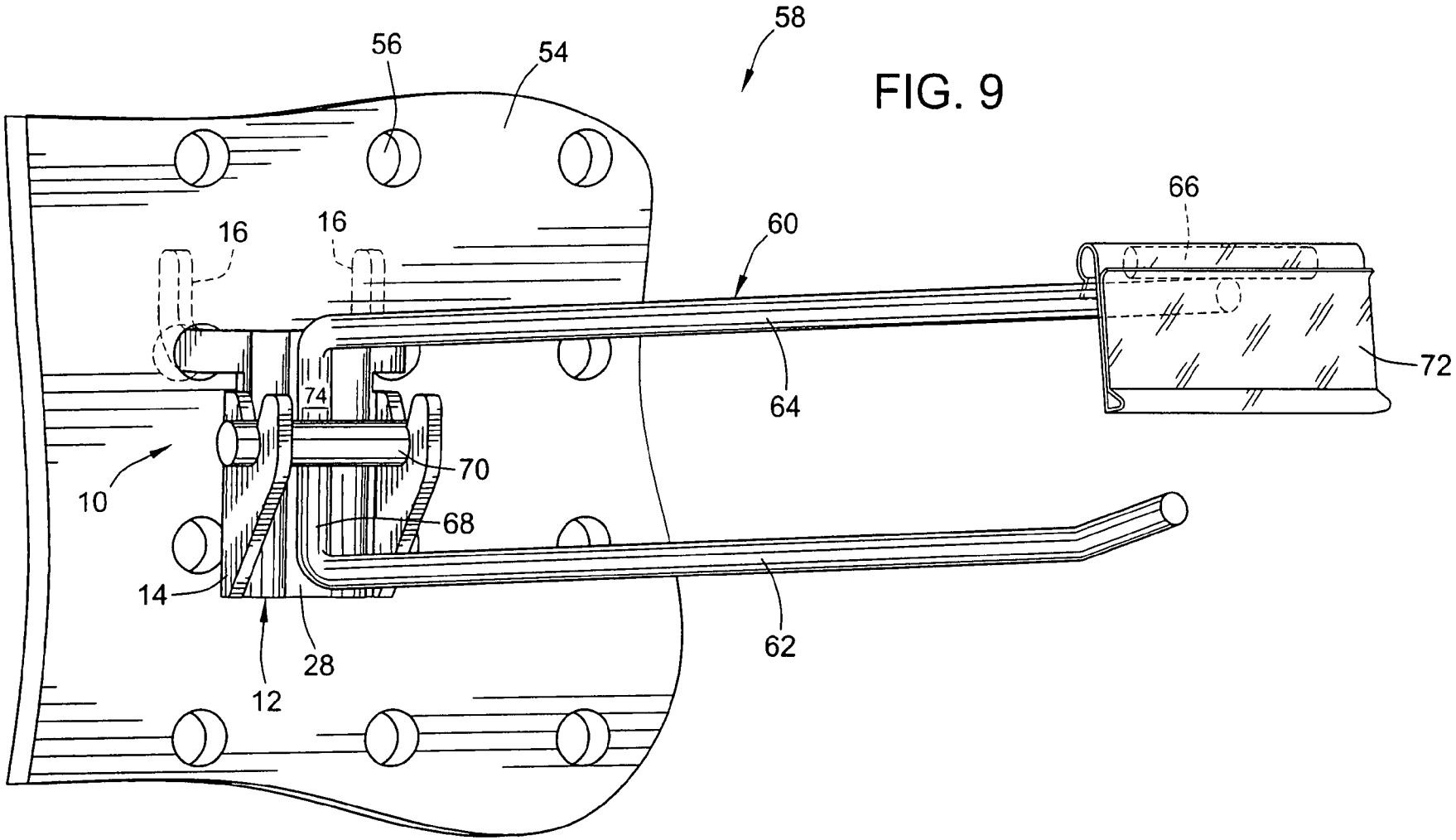
FIG. 9 is a perspective view of the back unit of FIG. 1 incorporated into a display hanger assembly and mounted to the peg board of FIG. 5.

In a preferred embodiment, as illustrated in FIG. 8, the back unit 10 is shown incorporated within a display hanger (or hook) assembly 58 subsequent to the back unit 10 being installed in the peg board 54. The display hanger assembly 58 comprises the back unit 10, and a hanger or hook 60. The hanger 60 includes a lower horizontally-extending hanger arm 62, an upper parallel hanger arm 64, a label cross wire 66, a vertical portion 68, and a cross bar 70. The lower hanger arm 62 is employed to support and display merchandise that is slid thereon. The upper hanger arm 64 is used to support the label cross wire 66 and a label holder 72 such as, for example, a "Uniscan" label holder, that is disposed on the cross bar. The vertical portion 68 is, in a preferred embodiment, integrally formed with, and interposed between, the lower and upper hanger arms 62, 64. The cross bar 70 is affixed and/or secured to an inside surface 74 of the vertical portion 68 by, for example, a weld. As such, the cross bar 70 is transverse to the vertical portion 68 and parallel to the lower and upper hanger arms 62, 64.

To install the hanger 60 in the back unit 10 as depicted in FIG. 8, the cross bar 70 is oriented above the arms 14 and the vertical portion 68 is aligned with the concave surface 28 of the vertical channel 26. As the hanger 60 is lowered, the cross bar 70 encounters the funnel portion 42 (FIG. 4) of the slot 40 (FIG. 4). The funnel portion 42 directs the cross bar downwardly into the arcuate portion 44 and past the locking element 46. As the cross bar 70 enters the arcuate portion 44 and passes the locking element 46, the vertical portion 68 engages the concave surface 28 and is therefore vertically aligned between the vertical ridges 32. Since the cross bar 70 and the arcuate portion 44 of the slot 40 are similarly sized and dimensioned, when the cross bar is disposed in the slot, the locking element 46 "locks" the cross bar 70 in the slot 40. In other words, the locking element 46 forcibly secures the cross bar 70 in the slot 40. As a result, the hook assembly 58 does not have to rely solely on the weight of the hanger 60 (or articles suspended therefrom) to keep the hanger secured within slots 40. The locking element 46 keeps the hanger 60 secured within the slots 40.

The vertical ridges 32 formed by the vertical channel 26 retain the vertical portion 68 of the hanger 60 in a centered position. The vertical ridges 32 also inhibit and/or prevent twisting of the hanger 60, and the like, such that the hanger is sturdily and safely secured and able to display merchandise to a customer.

Advantageously, as illustrated (FIG. 2), the body 12 has an increased cross section when compared to a flat piece of material. Therefore, the back unit 10 is strong, durable, and sufficiently stiff. Also, as shown and described, the slot 40 having a locking element 46 has the ability to positively retain the cross bar, and consequently the hanger 60, the slot 40 of the back unit 10. Even so, the cross bar 70, with sufficient upward pressure, can be biased upwardly and out of the slot 40 so that the arrangement can be replaced, removed, repositioned, and the like.

Additionally, another advantage regards the method of installation for the back unit. Because only the back unit 10 needs to be tilted to install the entire display hanger assembly 58 into a peg board 54, the display hanger assembly can be used in locations where conventional or typical display hangers can not. For instance, a typical display hanger assembly cannot be installed correctly under a shelf because the entire assembly or the hanger must be tilted upwardly and will strike the shelf. However, when a display hanger assembly 58 is used, only the back unit 10 is upwardly tilted. After the back unit 10 has been installed in the peg board 54, the hanger 60 is oriented as described above and dropped straight down. Since the hanger does not have to be tilted upwardly during the installation, the display hanger assembly 58, employing the back unit 10, provides a significant advantage to a commercial retailer in the business of displaying and offering for sale merchandise on display hanger assemblies.

Figure 10:
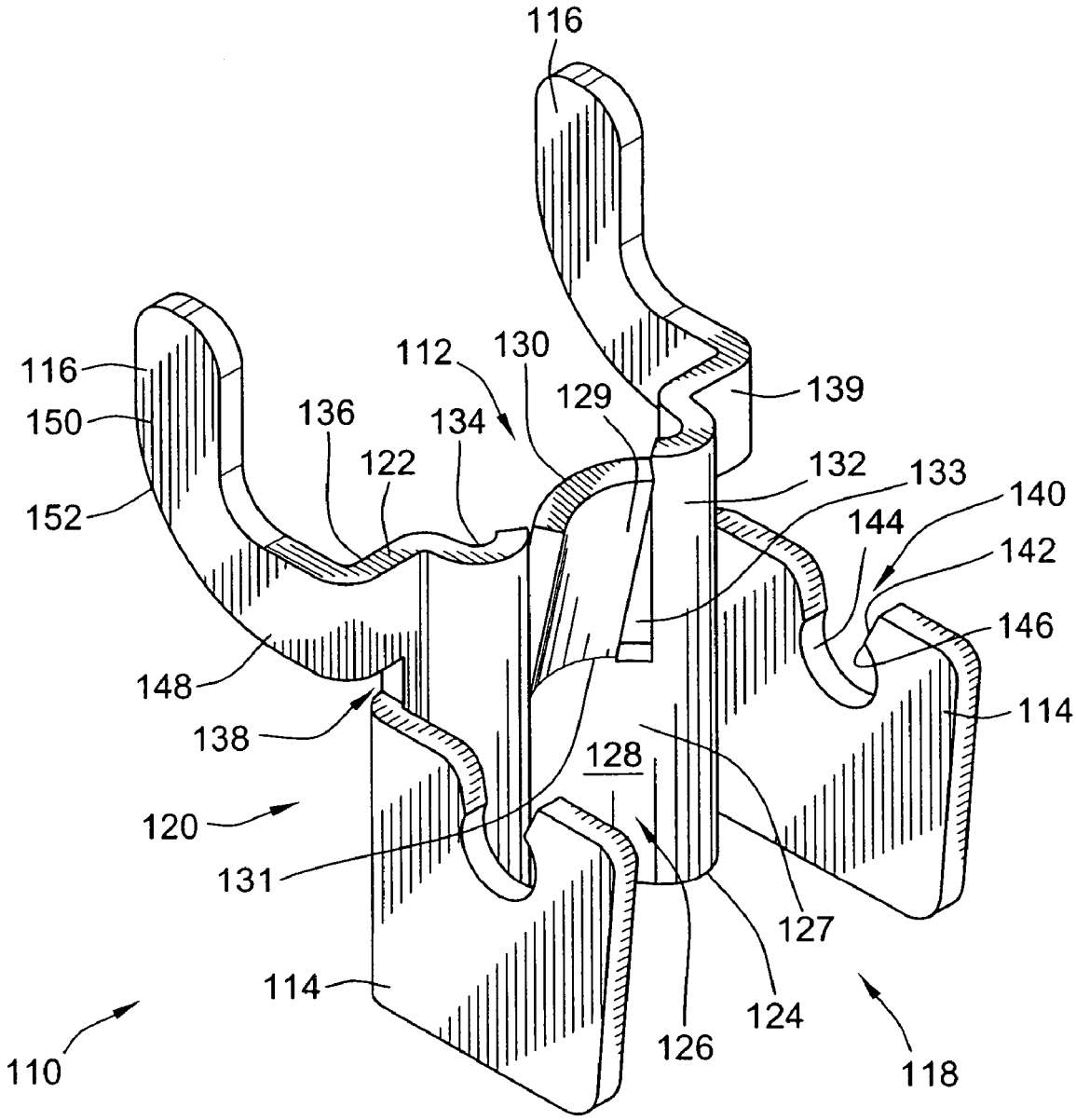
FIG. 10 is a perspective view of another embodiment of the back unit of FIG. 1.

In FIG. 10, a further embodiment of a back unit 110 is illustrated. The back unit 110 comprises a body 112, arms 114, and mounting tabs 116. The back unit 110 is preferably formed from a single piece of material such as, for example, stamped as a single piece from metal. As such, the body 112, arms 114, and mounting tabs 116 are all preferably integrally formed and unitary with each other.

The body 112 defines a first side 118, a second side 120, a top end 122, and a bottom end 124. As shown in FIG. 10, the body 112 includes a channel 126 that generally extends from the top end 122 to the bottom end 124 of the body 112. However, the channel 126 is partitioned into a bottom portion 127 and a top portion 129 at a central portion 131 of the channel 126. The top portion 129 is generally bent and/or angled forwardly toward the first side 118 beginning at or near the central portion 131 of the channel 126 while the bottom portion 127 of the channel 126 remains generally vertically oriented.

As those skilled in the art will readily appreciate, in the embodiment disclosed in FIG. 10, the top portion 129, which is angled and/or tilted forward with respect to the bottom portion 127, inhibits and/or prevents the hanger 60 from being dislodged after the hanger has been installed in the back unit 110 (FIG. 8). The forward tilt of the top portion 129 effectively and beneficially discourages upward movement and/or travel of the hanger 60, including the vertical portion 68 and/or the crossbar 70 of the hanger. Therefore, should, for example, a customer inadvertently upwardly strike the hanger 60 when the hanger is coupled with the back unit 110, the slanted top portion 129 will oppose upward movement and/or uncoupling. Thus, the hanger 60 will remain engaged with the back unit 110 and the merchandise being displayed will be unaffected.

Similar to notches 38 (FIG. 3), to assist in fabricating and forming the angled top portion 129, notches 133 extending from the central portion 131 to the top end 122 can be made on either side of the top portion 129 as depicted in FIG. 10. The notches 133 permit and/or augment the formation of the angled top portion 129 from a single piece of stamped material.

As shown in FIG. 10, the vertical channel 126 forms a concave surface 128 on the first side 118 of the body 112 and a convex surface 130 on the second side 120 of the body. Additionally, the vertical channel 126 forms a pair of parallel vertical ridges 132 on the first side 118 and, correspondingly, parallel recessed portions 134 on the second side 120. Like the vertical channel 126, the vertical ridge 132 and recessed portions 134 generally extend from the top end 122 to the bottom end 124 of the body 112.

Still referring to FIG. 10, the body 112 further includes abutment surfaces 136 formed on the second side 120 of the body 112. The abutment surfaces 136 generally extend between the top end 122 and the bottom end 124 of the body 112. The abutment surfaces 136 are generally outside the vertical channel 126 and adjacent to the recessed portions 134 and/or the vertical ridges 132. In one embodiment, each abutment surface 136 is interrupted by a notch 138. Each notch 138 is, in one embodiment, formed into the body 112 a distance that is equal to the width of the arm 114. As such, the notches 138 aid in the formation of the back unit 110 from a single piece of stamped metal. In particular, the arms 114 can be more easily bent transverse to the abutment surfaces 136 (and also in an opposite direction relative to the mounting tabs 116), and generally the body 112, when the notches 138 are provided. When bent in this manner, the arms 114 form an elbow 139 or bend.

The arms 114 extend outwardly and away from the first side 118 of the body 12. Unlike the arms 14 of the back unit 10 (FIG. 1), the arms 114 of the back unit 110 are generally square as opposed to generally triangular. Each of the arms 114 has formed therein a slot 140. In a preferred embodiment, the slot 140 includes a funnel portion 142 and an arcuate portion 144 that forms the sides and bottom of the slot. Where the funnel portion 142 and the arcuate portion 144 of the slot intersect, one or more locking elements 146 or contact points are formed. Notably, the slot 140 and the funnel portion 142 are open proximate the top end 122 of the body 112.

Still referring to FIG. 10, the mounting tabs 116 extend outwardly and away from the second side 120 of the body 112. The mounting tabs 116 include a generally horizontal portion 148 and a generally vertical portion 150 coupled by an elbow portion 152. The mounting tabs 116 are generally parallel with one another and, in a preferred embodiment, extend above the top end 122 of the body 112. In the disclosed embodiment, as best shown in FIG. 10, the outermost extremities of the mounting tabs 116 are outwardly displaced further than the arms 114 with respect to the body 112. Even so, the arms 114 and the mounting tabs 116 are parallel to each other and generally transverse to the body 112.

The back unit 110 provides and possesses the same general advantages and benefits of the back unit 10. Likewise, the back unit 110 is installed and disengaged from the peg board 54, coupled with the hanger 60, and/or incorporated into the display hanger assembly 58 in the same or similar manner as the back unit 10 (see FIGS. 5-9).

All references, including publications, patent applications, and patents cited herein are hereby incorporated by reference to the same extent as if each reference were individually and specifically indicated to be incorporated by reference and were set forth in its entirely herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A back unit for use in a display hanger assembly, the back unit comprising:

a body having a vertical channel, the vertical channel forming a concave surface on a first side and a convex surface on a second side;

arms integrally formed with the body, the arms extending outwardly away from the first side and including a slot; and mounting tabs integrally formed with the body, the mounting tabs extending outwardly away from the second side;

wherein the vertical channel is partitioned into a top portion and a bottom portion, the top portion angled forwardly toward the first side beginning at a central portion of the vertical channel.

2. The back unit of claim 1, wherein back unit is formed from a single piece of stamped metal.

3. The back unit of claim 2, wherein the body includes notches interposed between the arms and mounting tabs, the arms having a bend located at the notch.

4. The back unit of claim 1, wherein the vertical channel extends completely between a top end and a bottom end of the body.

5. The back unit of claim 1, wherein the arms are immediately adjacent to the body and the mounting tabs have extremities disposed outwardly outside a span of the arms.

6. The back unit of claim 1, wherein the slot includes a funnel portion and an arcuate portion, the arcuate portion below the funnel portion and forming a bottom of the slot to provide means for receiving a crossbar.

7. The back unit of claim 1, wherein the slot includes a funnel portion and an arcuate portion, an intersection of the funnel portion and the arcuate portion forming a locking element to provide means for retaining a cross bar installed in the slot.

8. The back unit of claim 1, wherein the arms and the mounting tabs are generally transverse with the body and generally parallel with each other.

9. The back unit of claim 1, wherein notches formed in the vertical channel extend from the central portion toward a top portion of the body and are disposed on either side of the top portion.

10. A back unit for use in a display hanger assembly that includes a hanger arm and a crossbar, the display hanger assembly compatible with a peg board having holes, the back unit comprising:

a body having a vertical channel, the vertical channel forming a concave surface on a first side of the body and a convex surface on a second side of the body, the concave surface engageable with the hanger arm, a portion of the convex surface engageable with the peg board;

arms integrally formed with the body, the arms extending outwardly away from the first side and including a slot dimensioned to receive the crossbar; and mounting tabs integrally formed with the body, the mounting tabs extending outwardly away from the second side and insertable into the holes in the peg board;

wherein the convex surface includes recessed portions, the recessed portions disposed away from the peg board when the back unit is mounted to the peg board.

11. The back unit of claim 10, wherein back unit is formed from a single piece of stamped metal.

12. The back unit of claim 10, wherein the body further includes abutment surfaces on the second side, the abutment surfaces engageable with the peg board.

13. The back unit of claim 10, wherein the vertical channel forms parallel ridges on the first side of the body, which extend away from an abutment surface, and corresponding recesses into the second side of the body.

14. The back unit of claim 10, wherein the slot includes a funnel portion and an arcuate portion, an intersection of the funnel portion and the arcuate portion forming a locking element, the locking element inhibiting removal of the crossbar from the slot.

15. The back unit of claim 10, wherein the vertical channel is portioned into a top portion and a bottom portion, the top portion angled forwardly toward the first side beginning proximate a central portion of the vertical channel.

16. The back unit of claim 10, wherein notches are formed in the vertical channel, the notches extending between a central portion of the vertical channel and a top portion of the body and disposed on opposing sides of the top portion.

17. A display hanger assembly for displaying merchandise, the display hanger assembly comprising:

a hanger having a vertical portion and a crossbar, the crossbar transversely affixed to the vertical portion; and an integral back unit formed from a single piece of metal, the integral back unit including:

a body having a vertical channel, the vertical channel forming a concave surface on a first side of the body and a convex surface on a second side of the body, the concave surface engage able with the vertical portion of the hanger arm;

arms integrally formed with the body, the arms extending outwardly away from the first side and including a slot, the slot dimensioned to receive the crossbar; and mounting tabs integrally formed with the body, the mounting tabs extending outwardly away from the second side;

wherein the vertical channel is partitioned into a top portion and a bottom portion, the top portion angled forwardly toward the first side beginning at a central portion of the vertical channel.

18. The display hanger assembly of claim 17, wherein the hanger includes a lower horizontally-extending hanger arm for supporting merchandise.

19. The display hanger assembly of claim 17, wherein the hanger includes an upper horizontally-extending hanger arm for supporting at least one of a label crosswire, a label holder, and a label.

20. The display hanger assembly of claim 17, wherein the slot includes a funnel portion and an arcuate portion, an intersection of the funnel portion and the arcuate portion forming a locking element, the locking element releasably securing the crossbar within the slot when the crossbar is received in the slot.

21. The display hanger assembly of claim 17, wherein the display hanger assembly further comprises a peg board.

22. The display hanger assembly of claim 21, wherein the pegboard includes a plurality of holes, selected ones of the plurality of holes releasably engageable with the mounting tabs.

23. The back unit of claim 17, wherein notches formed in the body extend from a central portion of the vertical channel toward a top portion of the body and are disposed on opposing sides of the top portion.

* * * * *